US008268769B2

(12) United States Patent
Enselberg

(10) Patent No.: US 8,268,769 B2
(45) Date of Patent: Sep. 18, 2012

(54) COMPOSITION AND METHOD FOR REMOVING STAINS FROM FABRICS

(76) Inventor: Hillary Enselberg, Boca Raton, FL (US)

( * ) Notice: Subject to any disclaimer, the term of this patent is extended or adjusted under 35 U.S.C. 154(b) by 0 days.

(21) Appl. No.: 13/101,552

(22) Filed: May 5, 2011

(65) Prior Publication Data

US 2011/0271458 A1 Nov. 10, 2011

Related U.S. Application Data

(60) Provisional application No. 61/343,862, filed on May 5, 2010.

(51) Int. Cl.
*C11D 7/08* (2006.01)
*C11D 3/44* (2006.01)
*C11D 1/90* (2006.01)

(52) U.S. Cl. ..... 510/283; 510/276; 510/281; 510/342; 510/358; 510/379; 510/432; 510/480; 510/490

(58) Field of Classification Search ..... 510/276, 510/281, 283, 342, 358, 379, 432, 480, 490
See application file for complete search history.

(56) References Cited

U.S. PATENT DOCUMENTS

2012/0058064 A1* 3/2012 Urban et al. ..... 424/68
* cited by examiner

*Primary Examiner* — Charles Boyer
(74) *Attorney, Agent, or Firm* — Robert M. Downey, P.A.

(57) ABSTRACT

An aqueous solution containing a combination of Phosphoric Acid, Emulsifying Wax, Triethlyene Glycol, Cocamido Propyl Beatine, Lauryl Alcohol, EDTA-Ethylenediaminetetraacetic Acid (polyamino carboxylic acid) and Sodium Hydrochloride is applied directly to stains on clothing that are caused by perspiration and/or the interaction of perspiration with commercial antiperspirants containing aluminum compounds. The aqueous solution converts aluminum oxide into a water-soluble phosphate compound that can be washed out when laundering the clothing, thereby effectively removing the stain.

14 Claims, No Drawings

COMPOSITION AND METHOD FOR REMOVING STAINS FROM FABRICS

BACKGROUND OF THE INVENTION

This non-provisional patent application is based on provisional patent application Ser. No. 61/343,862 filed on May 5, 2010.

FIELD OF THE INVENTION

The present invention relates to stain removing compositions and, more particularly, to compositions and a method for removing yellow stains from clothing caused by the interaction of human perspiration with commercial antiperspirants containing aluminum compounds.

DISCUSSION OF THE RELATED ART

The problem of the yellow armpit stains exists because many commercial antiperspirants utilize aluminum chlorohydrate and aluminum zirconium to block pores and inhibit sweat. When mixed with perspiration, these aluminum compounds are known to oxidize which produces a stain on the clothing having a yellowish tint. Well known stain removers and fabric whiteners, such as bleach, are not effective in removing the yellowish tint and can cause the stain to become permanently set in the fabric.

OBJECTS AND ADVANTAGES OF THE INVENTION

It is a primary object of the present invention to provide one or more stain removing compositions and a method for removing yellowish armpit stains from clothing caused by the interaction of perspiration with commercial antiperspirants containing aluminum compounds.

It is a further object of the present invention to provide one or more compositions adapted for removing yellow perspiration stains from clothing, and wherein the one or more compositions are provided as an aqueous solution that is adapted to be applied directly on the stain prior to laundering the clothing.

It is still a further object of the present invention to provide one or more compositions for removing yellow armpit stains from clothing, and wherein the one or more compositions are provided as an aqueous solution that is adapted to be applied directly to the yellow armpit stain and to convert the aluminum oxide that caused the yellow stain into a water-soluble phosphate compound that will wash out of the garment when laundered.

It is still a further object of the present invention to provide one or more compositions for the removal of yellow armpit stains caused by the interaction of perspiration with commercial antiperspirants containing aluminum compounds, and wherein the one or more compositions are adapted to be provided in a commercially available product to the general consumer at a reasonable price.

These and other objects of the present invention are more readily apparent with reference to the following description of the invention.

SUMMARY OF THE INVENTION

The present invention relates to a method for treating and removing stains found to occur in regions of garments exposed to perspiration. The composition of the present invention is an aqueous solution containing a combination of phosphoric acid, emulsifying wax, triethylene glycol, cocamido propyl betaine, lauryl alcohol, EDTA and sodium hydrochloride or sodium hydroxide. When this solution is applied directly on the stain, it converts aluminum oxide into a water-soluble phosphate compound. Once this reaction takes place, the garment can be laundered in order to remove the stain entirely. In use, the solution is applied to the entire effected area of the fabric. The treated area of the fabric is then rubbed together, left to sit for 5-10 minutes and then laundered with regular detergent.

DETAILED DESCRIPTION OF THE PREFERRED EMBODIMENTS

The invention is directed to a composition and method for removing stains from fabrics that are caused by the interaction of perspiration with aluminum compounds, such as aluminum oxide. The composition of the present invention is provided in an aqueous solution containing a combination of phosphoric acid, emulsifying wax, triethylene glycol, a surfactant, lauryl alcohol, EDTA-ethylenediaminetetraacetic acid (polyamino carboxylic acid), and sodium hydrochloride and/or sodium hydroxide.

The ingredients are present in the composition according to the following ranges:

| | |
|---|---|
| Phosphoric Acid | Between 15% and 45% by weight of the composition |
| Emulsifying Wax | Between 0.5% and 3% by weight of the composition |
| Triethylene Glycol | Between 0.5% and 3% by weight of the composition |
| Cocamido Propyl Beatine (as a surfactant) | Between 0.5% and 3% by weight of the composition |
| Lauryl Alcohol | Between 0.05% and 2% by weight of the composition |
| EDTA | Between 0.01% and 2.0% by weight of the composition |
| Sodium Hydroxide | Between 0.01% and 0.5% by weight of the composition |
| Sodium Hydrochloride | Between 0.01% and 0.5% by weight of the composition |
| Water | Between 55.0% and 75% by weight of the composition |

EXAMPLE 1

A first example of the stain removing composition comprises a combination of 68.4% water, 26.0% phosphoric acid, 1.5% emulsifying wax, 1.5% Triethylene Glycol, 1% Surfactant (Cocamido Propyl Betaine), 1% Lauryl Alcohol, 0.5% EDTA, and 0.1% Sodium Hydroxide or 0.1% Sodium Hydrochloride.

EXAMPLE 2

A second example of the stain removing composition comprises a combination of 47.4% water, 41.0% phosphoric acid, 2.5% emulsifying wax, 2.5% Triethylene Glycol, 2% Surfactant (Cocamido Propyl Betaine), 2% Lauryl Alcohol, 1.5% EDTA, and 1.1% Sodium Hydroxide or 1.1% Sodium Hydrochloride.

According to the method of the present invention, the composition is provided in an aqueous solution containing a combination of phosphoric acid, emulsifying wax, triethylene glycol, a surfactant, lauryl alcohol, EDTA and sodium hydrochloride or sodium hydroxide. The aqueous solution is applied directly to the stain on a fabric. Next, the area of the fabric that has the aqueous solution applied thereto is rubbed together in order to agitate the aqueous solution within the fibers of the fabric. The interaction of the aqueous solution with the stain converts the aluminum oxide in the stain into a water-soluble phosphate compound which can be removed from the fabric in a normal laundering process. After rubbing the fabric, the garment is allowed to sit for 5-10 minutes and then is placed in a conventional clothes washing machine and laundered with regular detergent. After washing, the garment can be hang dried or placed in a conventional clothes dryer.

While the present invention has been described in accordance with several preferred and practical embodiments thereof, it is recognized that departures from the instant disclosure are contemplated within the spirit and scope of the present invention.

What is claimed is:

1. A composition for removing stains from fabrics comprising:

Phosphoric Acid;
Emulsifying Wax;
Triethylene Glycol;
a surfactant;
Lauryl Alcohol;
Ethylenediaminetetraacetic Acid;
Sodium Hydrochloride; and
Water.

2. The composition as recited in claim 1 wherein said surfactant is Cocamido Propyl Beatine.

3. The composition as recited in claim 1 wherein phosphoric acid is present in an amount of between 15% and 45% by weight of the composition.

4. The composition as recited in claim 3 wherein the emulsifying wax is present in an amount of between 0.5% and 3% by weight of the composition.

5. The composition as recited in claim 4 wherein triethylene glycol is present in an amount of between 0.5% and 3% by weight of the composition.

6. The composition as recited in claim 5 wherein the surfactant is present in an amount of between 0.5% and 3% by weight of the composition.

7. The composition as recited in claim 6 wherein lauryl alcohol is present in an amount of between 0.05% and 2% by weight of the composition.

8. The composition as recited in claim 7 wherein Ethylenediaminetetraacetic Acid is present in an amount of between 0.01% and 2% by weight of the composition.

9. The composition as recited in claim 8 wherein sodium hydrochloride is present in amount of between 0.01% and 0.5% by weight of the composition.

10. The composition as recited in claim 9 wherein water is present in an amount of between 55% and 75% by weight of the composition.

11. The composition as recited in claim 1 further comprising:

sodium hydroxide.

12. The composition as recited in claim 11 wherein sodium hydroxide is present in an amount of between 0.01% and 0.5% by weight of the composition.

13. A composition for removing stains from fabrics comprising:

Phosphoric Acid;
Emulsifying Wax;
Triethylene Glycol;
a surfactant;
Lauryl Alcohol;
Ethylenediaminetetraacetic Acid;
Sodium Hydroxide; and
Water.

14. A method for removing stains from fabrics that are caused by the interaction of perspiration with aluminum compounds, said method comprising the steps of:

providing a composition in the form of an aqueous solution comprising phosphoric acid, emulsifying wax, triethylene glycol, a surfactant, lauryl alcohol, ethylenediaminetetraacetic acid, sodium hydrochloride, and water;

applying the aqueous solution directly on the one or more stains on the fabric;

rubbing the one or more stains on the fabric together and agitating the aqueous solution within the fibers of the fabric;

allowing the aqueous solution to interact with one or more aluminum compounds in the stained areas of the fabric for at least 5 minutes; and laundering the fabric in water mixed with a laundry detergent.

* * * * *